US007428836B2

(12) United States Patent
Yang et al.

(10) Patent No.: US 7,428,836 B2
(45) Date of Patent: Sep. 30, 2008

(54) DOOR LOCK HAVING REINFORCED STRENGTH

(76) Inventors: Zhen-Lin Yang, 5, Lane 88, Minzu Rd., Beidou Zhen, Changhua Hsien (TW); Sheng-Jan Yang, 5, Lane 88, Minzu Rd., Beidou Zhen, Changhua Hsien (TW); Mu-Gui Yang, 5, Lane 88, Minzu Rd., Beidou Zhen, Changhua Hsien (TW)

( * ) Notice: Subject to any disclaimer, the term of this patent is extended or adjusted under 35 U.S.C. 154(b) by 321 days.

(21) Appl. No.: 11/333,674

(22) Filed: Jan. 17, 2006

(65) Prior Publication Data

US 2007/0163315 A1 Jul. 19, 2007

(51) Int. Cl.
*E05B 17/04* (2006.01)

(52) U.S. Cl. ..... 70/379 R; 70/369; 70/375; 70/417

(58) Field of Classification Search ..... 70/379 R, 70/379 A, 367–369, 373, 375, 417, DIG. 60
See application file for complete search history.

(56) References Cited

U.S. PATENT DOCUMENTS

| | | | | | |
|---|---|---|---|---|---|
| 3,293,892 | A * | 12/1966 | Falk | 70/493 |
| 4,195,504 | A * | 4/1980 | Foshee | 70/369 |
| 4,292,824 | A * | 10/1981 | Keller | 70/373 |
| 4,522,048 | A * | 6/1985 | Davis | 70/417 |
| 4,587,816 | A * | 5/1986 | Garcia | 70/417 |
| 4,603,566 | A * | 8/1986 | Kruehn et al. | 70/380 |
| 4,679,418 | A * | 7/1987 | Allen | 70/380 |
| 5,479,801 | A * | 1/1996 | Keller | 70/373 |
| 5,666,835 | A * | 9/1997 | Keller | 70/397 |
| 5,839,305 | A * | 11/1998 | Aston | 70/283.1 |
| 5,893,282 | A * | 4/1999 | Runge et al. | 70/208 |
| 5,921,122 | A * | 7/1999 | Lin | 70/368 |
| 6,508,088 | B1 * | 1/2003 | Barbier et al. | 70/186 |
| 6,604,394 | B2 * | 8/2003 | Davis | 70/278.3 |
| 6,606,890 | B1 * | 8/2003 | Widen | 70/369 |
| 6,718,806 | B2 * | 4/2004 | Davis | 70/278.3 |
| 6,889,533 | B2 * | 5/2005 | Fuller | 70/375 |
| 7,059,160 | B2 * | 6/2006 | Keller | 70/375 |
| 2004/0040355 | A1 * | 3/2004 | Goldman | 70/278.3 |
| 2005/0034496 | A1 * | 2/2005 | Fuller | 70/375 |
| 2006/0283218 | A1 * | 12/2006 | Dolev | 70/379 R |

* cited by examiner

*Primary Examiner*—Suzanne D Barrett
(74) *Attorney, Agent, or Firm*—Alan Kamrath; Kamrath & Associates PA

(57) ABSTRACT

A door lock includes a support seat having a recess for mounting a driven member, a control knob including a drive member rotatably mounted in the support seat to rotate the driven member and a rotation member to rotate the drive member and having an outer wall formed with an annular groove and a locking groove, and a locking pin mounted in the support seat and having a locking end selectively extended into the annular groove or the locking groove of the rotation member of the control knob. Thus, the door lock has a dead locking function to lock the door from inside to prevent the door from being unlocked from outside by a key or other tool so as to protect the user's safety inside of the door.

20 Claims, 5 Drawing Sheets

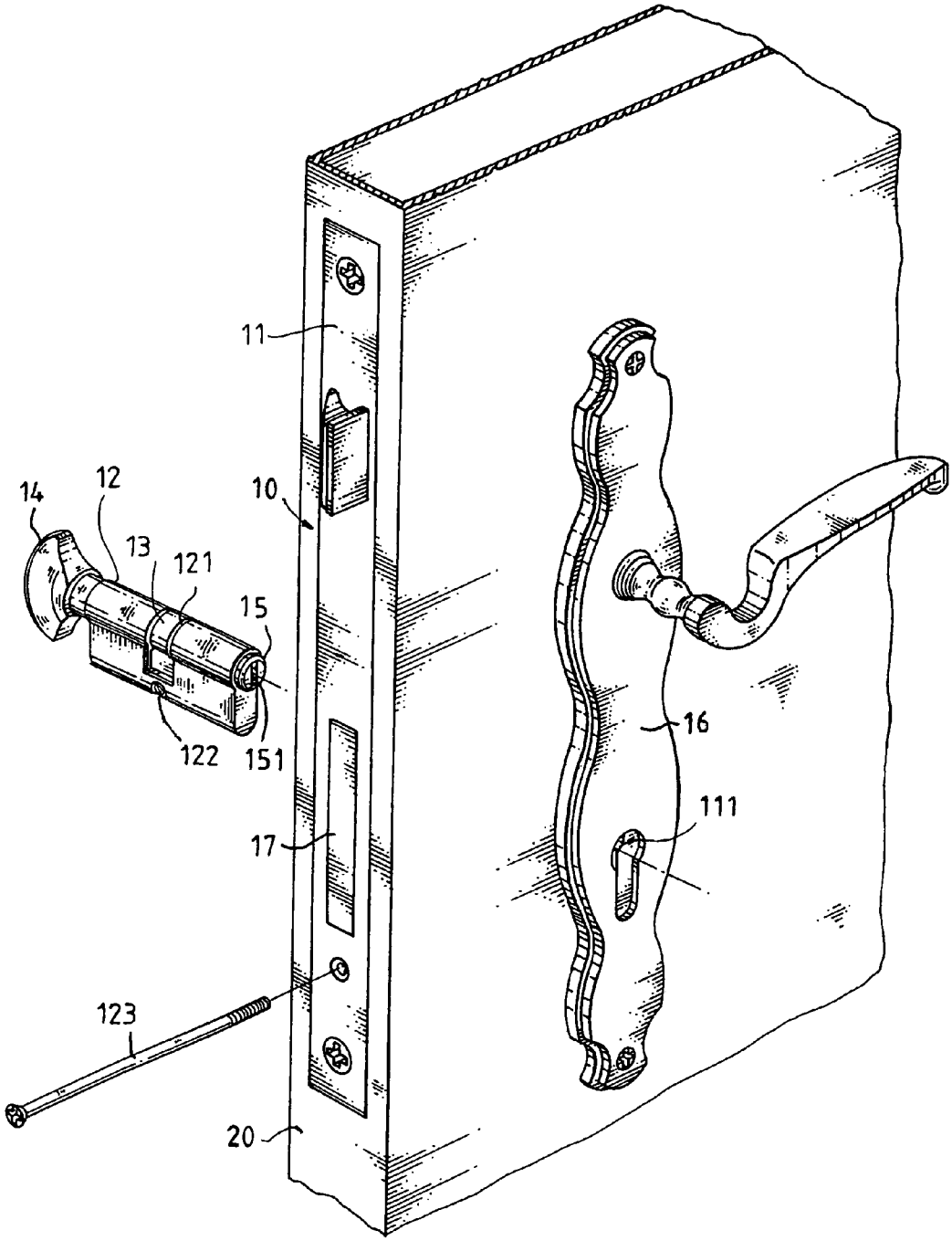
Fig . 5 PRIORT ART

DOOR LOCK HAVING REINFORCED STRENGTH

BACKGROUND OF THE INVENTION

1. Field of the Invention

The present invention relates to a locking device and, more particularly, to a door lock for a house.

2. Description of the Related Art

A conventional door lock 10 in accordance with the prior art shown in FIG. 5 comprises a frame 11 mounted in a door 20 and having a through hole 111, a cover plate 16 mounted outside of the door 20, a dead bolt 17 retractably mounted on the frame 11, a support seat 12 mounted in the through hole 111 of the frame 11 and having a mediate portion formed with a recess 121 and a screw bore 122, a locking bolt 123 extended through the frame 11 and screwed into the screw bore 122 of the support seat 12, a driven member 13 rotatably mounted in the recess 121 of the support seat 12 to drive and move the dead bolt 17 so as to lock or unlock the door 20, a rotation knob 14 mounted on a first portion of the support seat 12 and having an end portion secured to a first portion of the driven member 13 to rotate the driven member 13, and a lock core 15 mounted on a second portion of the support seat 12 and secured to a second portion of the driven member 13 to rotate the driven member 13. When in use, the rotation knob 14 drives and rotates the driven member 13 to drive and move the dead bolt 17 so as to lock or unlock the door 20. Alternatively, a key (not shown) is inserted through the through hole 111 of the frame 11 into the key hole 151 of the lock core 15 and is rotated to rotate the driven member 13 to drive and move the dead bolt 17 so as to lock or unlock the door 20.

However, the door lock 10 does not have a dead locking function to lock the door 20 from inside of the door 20, so that a person can use a key or other tool to unlock the lock core 15 to rotate the driven member 13 to drive and move the dead bolt 17 so as unlock the door 20, thereby causing danger to the user inside of the door. In addition, the wall of the recess 121 for mounting the driven member 13 is the weakest portion of the support seat 12, so that a person can break the cover plate 16 to expose the lock core 15 outward from the door 20 and can hit the lock core 15 by a tool to break the wall of the recess 121 of the support seat 12, thereby breaking the door lock 10.

SUMMARY OF THE INVENTION

In accordance with the present invention, there is provided a door lock, comprising a support seat having a mediate portion formed with a recess, a driven member rotatably mounted in the recess of the support seat, a control knob mounted on a first portion of the support seat and including a first drive member rotatably mounted in the first portion of the support seat and secured to a first portion of the driven member to rotate the driven member and a rotation member mounted on the first drive member to rotate the first drive member and having an outer wall formed with an annular groove and an axially extending locking groove connected to the annular groove, and a locking pin mounted in the first portion of the support seat and having a locking end selectively extended into the annular groove or the locking groove of the rotation member of the control knob.

The primary objective of the present invention is to provide a door lock having a reinforced strength to prevent a thief from breaking the door lock by an impact force.

Another objective of the present invention is to provide a door lock, wherein the door lock has a dead locking function to lock the door constantly from inside of the door to prevent the door from being unlocked from outside of the door by a key or other tool so as to protect the user's safety inside of the door.

A further objective of the present invention is to provide a door lock, wherein the reinforcing plate reinforces the strength of the weakest portion of the support seat, so that the door lock has a reinforced strength to prevent a person from breaking the door lock by a stronger external force.

Further benefits and advantages of the present invention will become apparent after a careful reading of the detailed description with appropriate reference to the accompanying drawings.

BRIEF DESCRIPTION OF THE DRAWINGS

FIG. 5 is a perspective view of a conventional door lock in accordance with the prior art.

DETAILED DESCRIPTION OF THE INVENTION

Figure 1:
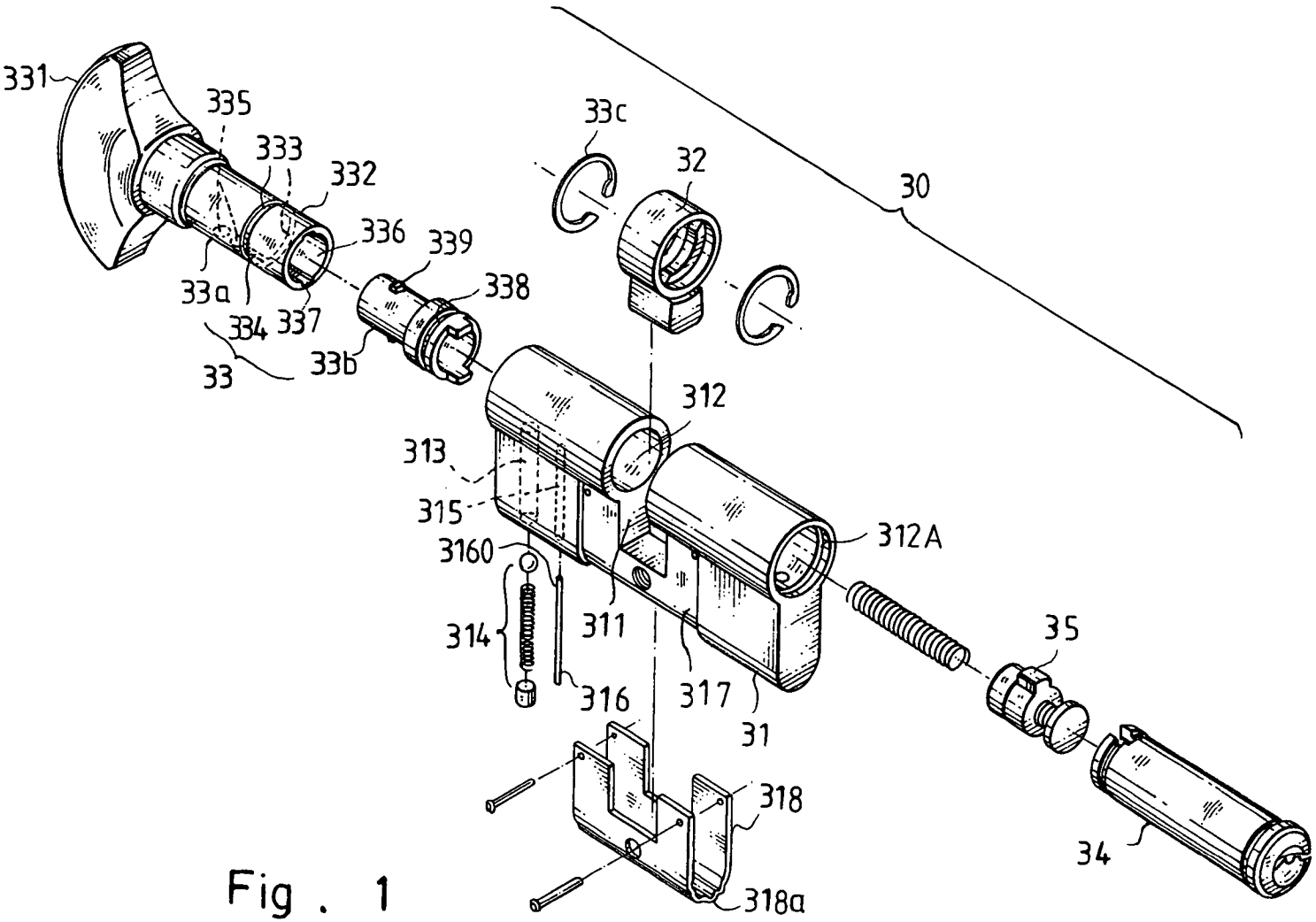
FIG. 1 is an exploded perspective view of a door lock in accordance with the preferred embodiment of the present invention.
Figure 2:
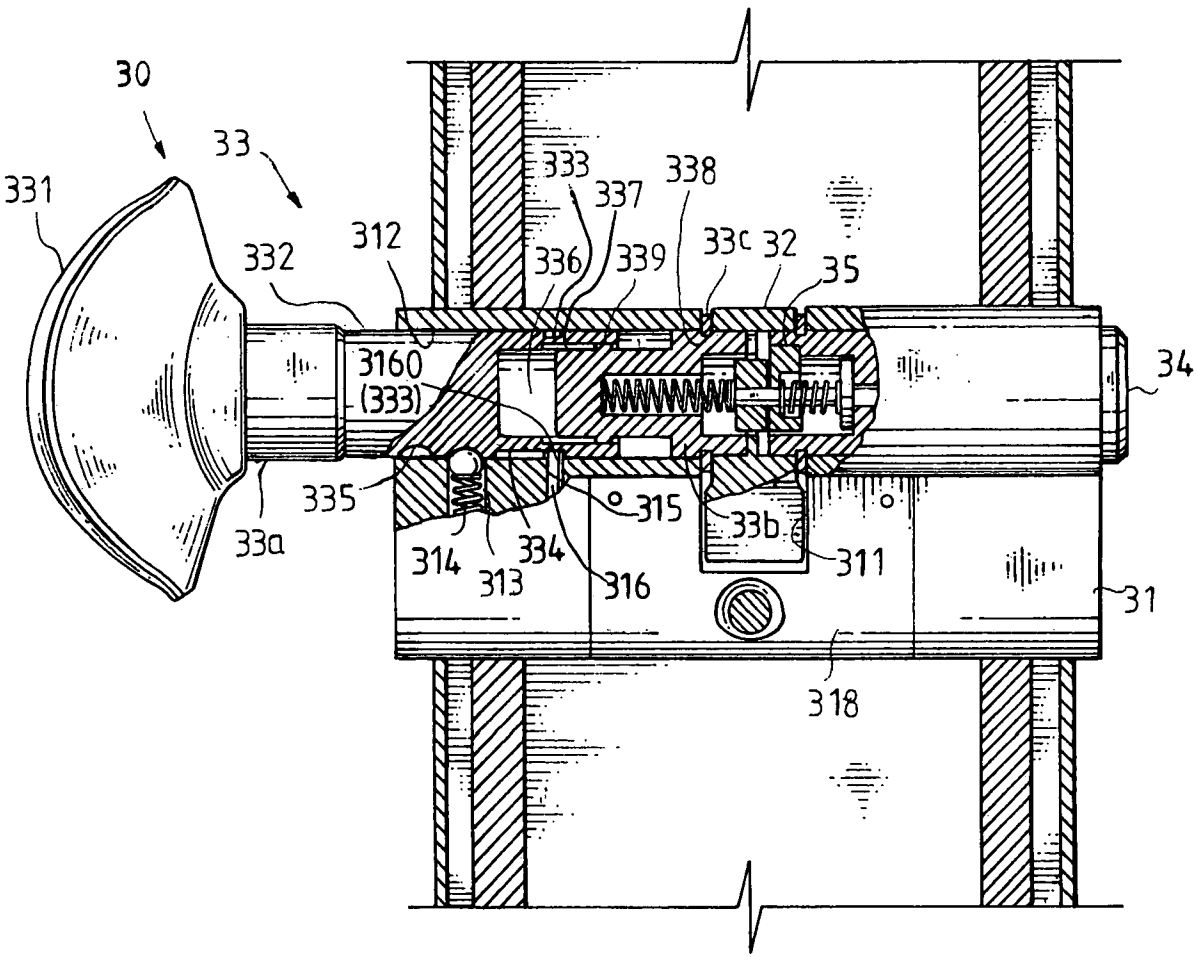
FIG. 2 is a partially plan cross-sectional assembly view of the door lock as shown in FIG. 1.
Figure 3:
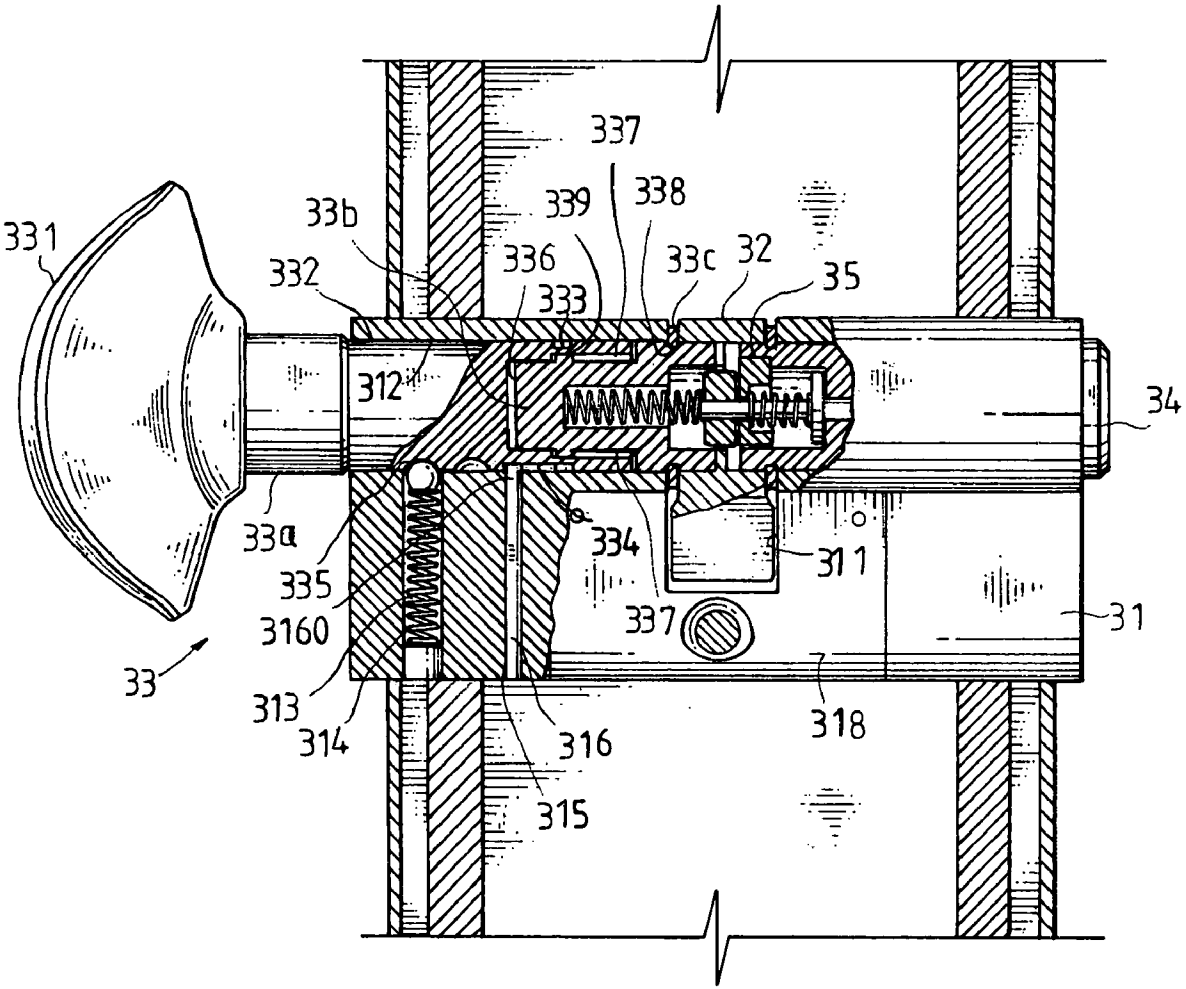
FIG. 3 is a schematic operational view of the door lock as shown in FIG. 2.

Referring to the drawings and initially to FIGS. 1-3, a door lock 30 in accordance with the preferred embodiment of the present invention comprises a support seat 31 having a mediate portion formed with a recess 311, a driven member 32 rotatably mounted in the recess 311 of the support seat 31 to drive and move a dead bolt (not shown) so as to lock or unlock a door (not shown), a control knob 33 mounted on a first portion of the support seat 31 and including a first drive member 33*b* rotatably mounted in the first portion of the support seat 31 and secured to a first portion of the driven member 32 to rotate the driven member 32 and a rotation member 33*a* mounted on the first drive member 33*b* to rotate the first drive member 33*b* and having an outer wall formed with an annular groove 333 and an axially extending locking groove 334 connected to the annular groove 333, a locking pin 316 mounted in the first portion of the support seat 31 and having a locking end 3160 selectively extended into the annular groove 333 or the locking groove 334 of the rotation member 33*a* of the control knob 33, a lock core 34 mounted on a second portion of the support seat 31, and a second drive member 35 rotatably mounted in the lock core 34 and secured to a second portion of the driven member 32 to rotate the driven member 32.

When in use, the control knob 33 drives and rotates the driven member 32 to drive and move the dead bolt so as to lock or unlock the door. Alternatively, a key (not shown) is inserted into the lock core 34 to push the second drive member 35 to lock the driven member 32 and is rotated to rotate the second drive member 35 which rotates the driven member 32 to drive and move the dead bolt so as to lock or unlock the door.

In operation, the rotation member 33*a* of the control knob 33 is axially movable relative to the support seat 31 between a first position where the locking end 3160 of the locking pin 316 is extended into the annular groove 333 of the rotation member 33*a* of the control knob 33, so that the rotation member 33*a* of the control knob 33 is rotatable freely relative to the support seat 31 to rotate the first drive member 33*b*, and the locking end 3160 of the locking pin 316 is rotatable in the annular groove 333 of the rotation member 33*a* by rotation of the rotation member 33*a*, and a second position where the locking end 3160 of the locking pin 316 is extended into the locking groove 334 of the rotation member 33*a* of the control knob 33, so that the rotation member 33*a* of the control knob 33 is locked by the locking pin 316 to lock the first drive member 33*b* which locks the driven member 32.

The first drive member 33*b* of the control knob 33 has a first portion provided with two radially opposite slides 339 and a second portion secured to the first portion of the driven member 32. The second portion of the first drive member 33*b* has an outer wall formed with an annular retaining groove 338 for retaining a snap ring 33*c* which is located between a side wall of the recess 311 of the support seat 31 and a side wall of the driven member 32 to axially limit the first drive member 33*b* between the rotation member 33*a* and the driven member 32.

The rotation member 33*a* of the control knob 33 has an inner wall formed with two radially opposite axially extending slideways 337 slidably mounted on the slides 339 of the first drive member 33*b*, so that the rotation member 33*a* of the control knob 33 is axially movable relative to the first drive member 33*b*. The outer wall of the rotation member 33*a* is formed with two axially arranged positioning grooves 335. The rotation member 33*a* of the control knob 33 has a first portion provided with a mounting tube 332 mounted on the first drive member 33*b* and a second portion provided with an enlarged grip portion 331. The mounting tube 332 of the rotation member 33*a* has an inside formed with a receiving chamber 336 to receive the first drive member 33*b*.

The first portion of the support seat 31 is formed with an axially extending first mounting hole 312 for mounting the control knob 33, and the second portion of the support seat 31 is formed with an axially extending second mounting hole 312A for mounting the lock core 34. The recess 311 of the support seat 31 is located between the first portion and the second portion of the support seat 31. The first portion of the support seat 31 is formed with a pin hole 315 connected to the first mounting hole 312 for mounting the locking pin 316 which extended through the pin hole 315 into the first mounting hole 312.

A spring-biased elastic positioning member 314 is mounted in the first portion of the support seat 31 and is detachably positioned in either one of the two positioning grooves 335 of the rotation member 33*a*. The first portion of the support seat 31 is formed with a receiving space 313 connected to the first mounting hole 312 for mounting the elastic positioning member 314 which extended through the receiving space 313 into the first mounting hole 312.

A substantially U-shaped metallic reinforcing plate 318 is mounted on the mediate portion of the support seat 31 and enclosed around a connection of the recess 311, the first portion and the second portion of the support seat 31 to reinforce the strength of a wall of the recess 311 of the support seat 31. The mediate portion of the support seat 31 has a peripheral wall formed with a depression 317 for mounting the reinforcing plate 318. The reinforcing plate 318 has a bottom formed with a plurality of axially extending corrugated ribs 318*a* to reinforce the strength of the reinforcing plate 318.

As shown in FIGS. 1 and 2, when the rotation member 33*a* of the control knob 33 is axially movable (pulled outward) relative to the support seat 31 to the first position, the locking end 3160 of the locking pin 316 is extended into the annular groove 333 of the rotation member 33*a* of the control knob 33 as shown in FIG. 2, so that the rotation member 33*a* of the control knob 33 is rotatable freely relative to the support seat 31 to rotate the first drive member 33*b* which drives and rotates the driven member 32 to drive and move the dead bolt so as to lock or unlock the door. Alternatively, a key is inserted into the lock core 34 to push the second drive member 35 to lock the driven member 32 and is rotated to rotate the second drive member 35 which rotates the driven member 32 to drive and move the dead bolt so as to lock or unlock the door.

As shown in FIGS. 1 and 3, when the rotation member 33*a* of the control knob 33 is axially movable (pushed inward) relative to the support seat 31 to the second position, the locking end 3160 of the locking pin 316 is extended into the locking groove 334 of the rotation member 33*a* of the control knob 33 as shown in FIG. 3, so that the rotation member 33*a* of the control knob 33 is locked by the locking pin 316 to lock the first drive member 33*b* which locks the driven member 32. Thus, when a key is inserted into the lock core 34 to push the second drive member 35 to lock the driven member 32 and is rotated to rotate the second drive member 35, the driven member 32 is locked by the first drive member 33*b* of the control knob 33, so that the driven member 32 cannot be driven by the second drive member 35, thereby locking the dead bolt so as to lock the door constantly to prevent the door from being unlocked from outside of the door by a key or other tool. Thus, the door lock 30 has a dead locking function to lock the door constantly from inside of the door to prevent the door from being unlocked from outside of the door by a key or other tool.

Figure 4:
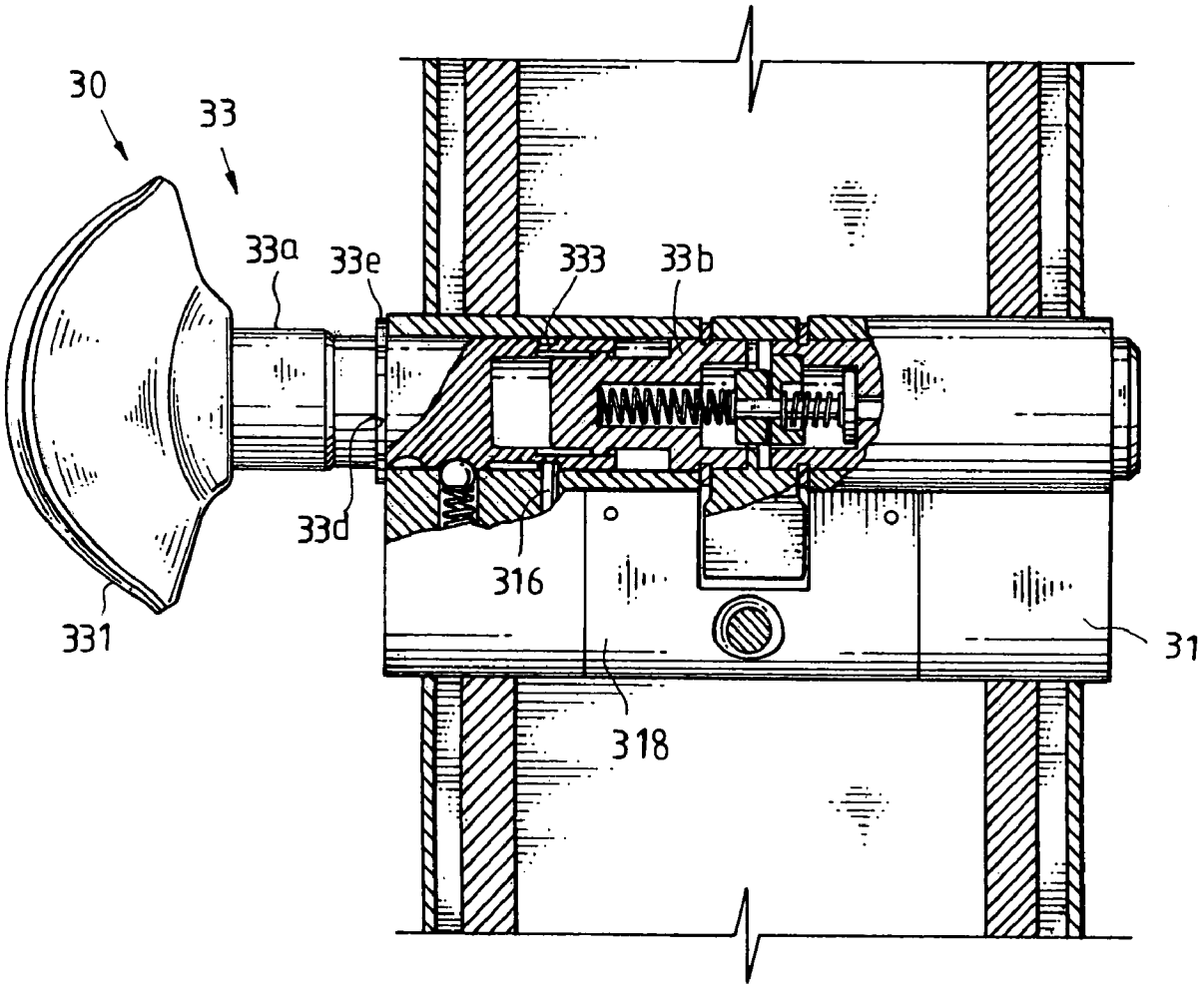
FIG. 4 is a partially plan cross-sectional assembly view of a door lock in accordance with another preferred embodiment of the present invention.

As shown in FIGS. 1 and 4, the outer wall of the rotation member 33*a* has a mediate portion formed with an annular retaining groove 33*d* for retaining a snap ring 33*e* which is rested on a side wall of the support seat 31 to limit movement of the rotation member 33*a*, so that the rotation member 33*a* will not be locked by the locking pin 316.

Accordingly, the door lock 30 has a dead locking function to lock the door constantly from inside of the door to prevent the door from being unlocked from outside of the door by a key or other tool so as to protect the user's safety inside of the door. In addition, the reinforcing plate 318 reinforces the strength of the weakest portion (that is, the wall of the recess 311 for mounting the driven member 32) of the support seat 31, so that the door lock 30 has a reinforced strength to prevent a person from breaking the door lock 30 by a stronger external force.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A door lock, comprising:

a support seat having a mediate portion formed with a recess;

a driven member rotatably mounted in the recess of the support seat;

a control knob mounted on a first portion of the support seat and including a first drive member rotatably mounted in the first portion of the support seat and secured to a first portion of the driven member to rotate the driven member, and a rotation member mounted on the first drive member to rotate the first drive member and having an outer wall formed with an annular groove and an axially extending locking groove connected to the annular groove;

a locking pin mounted in the first portion of the support seat and having a locking end selectively extended into the annular groove or the locking groove of the rotation member of the control knob.

2. The door lock in accordance with claim 1, wherein the rotation member of the control knob is axially movable relative to the support seat between a first position where the locking end of the locking pin is extended into the annular groove of the rotation member of the control knob, so that the rotation member of the control knob is rotatable freely relative to the support seat to rotate the first drive member, and the locking end of the locking pin is rotatable in the annular groove of the rotation member by rotation of the rotation member, and a second position where the locking end of the locking pin is extended into the locking groove of the rotation member of the control knob, so that the rotation member of the control knob is locked by the locking pin to lock the first drive member which locks the driven member.

3. The door lock in accordance with claim 1, wherein the first drive member of the control knob has a first portion provided with two radially opposite slides, and the rotation member of the control knob has an inner wall formed with two radially opposite axially extending slideways slidably mounted on the slides of the first drive member, so that the rotation member of the control knob is axially movable relative to the first drive member.

4. The door lock in accordance with claim 3, wherein the first drive member of the control knob has a second portion secured to the first portion of the driven member.

5. The door lock in accordance with claim 4, wherein the second portion of the first drive member has an outer wall formed with an annular retaining groove for retaining a snap ring which is located between a side wall of the recess of the support seat and a side wall of the driven member to axially limit the first drive member between the rotation member and the driven member.

6. The door lock in accordance with claim 1, wherein the rotation member of the control knob has a first portion provided with a mounting tube mounted on the first drive member and a second portion provided with an enlarged grip portion.

7. The door lock in accordance with claim 6, wherein the mounting tube of the rotation member has an inside formed with a receiving chamber to receive the first drive member.

8. The door lock in accordance with claim 1, wherein the first portion of the support seat is formed with an axially extending first mounting hole for mounting the control knob.

9. The door lock in accordance with claim 8, wherein the first portion of the support seat is formed with a pin hole connected to the first mounting hole for mounting the locking pin which extended through the pin hole into the first mounting hole.

10. The door lock in accordance with claim 8, wherein the outer wall of the rotation member is formed with two axially arranged positioning grooves, and the door lock further comprises a spring-biased elastic positioning member mounted in the first portion of the support seat and detachably positioned in either one of the two positioning grooves of the rotation member.

11. The door lock in accordance with claim 10, wherein the first portion of the support seat is formed with a receiving space connected to the first mounting hole for mounting the elastic positioning member which extended through the receiving space into the first mounting hole.

12. The door lock in accordance with claim 1, further comprising a metallic reinforcing plate is mounted on the mediate portion of the support seat to reinforce a strength of a wall of the recess of the support seat.

13. The door lock in accordance with claim 12, wherein the reinforcing plate is substantially U-shaped.

14. The door lock in accordance with claim 12, wherein the reinforcing plate is enclosed around a connection of the recess, the first portion and the second portion of the support seat.

15. The door lock in accordance with claim 12, wherein the reinforcing plate has a bottom formed with a plurality of axially extending corrugated ribs to reinforce a strength of the reinforcing plate.

16. The door lock in accordance with claim 12, wherein the mediate portion of the support seat has a peripheral wall formed with a depression for mounting the reinforcing plate.

17. The door lock in accordance with claim 8, further comprising a lock core mounted on a second portion of the support seat, and a second drive member rotatably mounted in the lock core and secured to a second portion of the driven member to rotate the driven member.

18. The door lock in accordance with claim 17, wherein the second portion of the support seat is formed with an axially extending second mounting hole for mounting the lock core.

19. The door lock in accordance with claim 1, wherein the recess of the support seat is located between the first portion and the second portion of the support seat.

20. The door lock in accordance with claim 1, wherein the outer wall of the rotation member has a mediate portion formed with an annular retaining groove for retaining a snap ring which is rested on a side wall of the support seat to limit movement of the rotation member.

* * * * *